US005397884A

United States Patent [19]

Saliga

[11] Patent Number: 5,397,884

[45] Date of Patent: Mar. 14, 1995

[54] ELECTRONIC KAY STORING TIME-VARYING CODE SEGMENTS GENERATED BY A CENTRAL COMPUTER AND OPERATING WITH SYNCHRONIZED OFF-LINE LOCKS

[76] Inventor: Thomas V. Saliga, 4702 Baycrest Dr., Tampa, Hillsborough County, Fla. 33615

[21] Appl. No.: 133,904

[22] Filed: Oct. 12, 1993

[51] Int. Cl.[6] ..... E05B 49/00

[52] U.S. Cl. ..... 235/382.5; 235/382; 340/825.31; 340/825.32

[58] Field of Search ..... 340/825.31, 825.32; 235/382, 382.5

[56] References Cited

U.S. PATENT DOCUMENTS

| | | | |
|---|---|---|---|
| 3,906,447 | 9/1975 | Crafton | 340/825.31 |
| 4,596,985 | 6/1986 | Bongard et al. | 340/825.31 |
| 4,646,080 | 2/1987 | Genest et al. | 340/825.31 |
| 4,870,400 | 9/1989 | Downs et al. | 235/382 |
| 4,928,098 | 5/1990 | Dannhaeuser | 340/825.31 |
| 4,988,987 | 1/1991 | Barrett et al. | 340/825.31 |
| 5,140,317 | 8/1992 | Hyatt, Jr. et al. | 340/825.31 |
| 5,198,643 | 3/1993 | Miron et al. | 235/382 |
| 5,204,663 | 4/1993 | Lee | 340/825.31 |

FOREIGN PATENT DOCUMENTS

| | | | |
|---|---|---|---|
| 1595796 | 8/1981 | United Kingdom | 235/382 |
| 2241734 | 9/1991 | United Kingdom | 340/825.31 |

*Primary Examiner*—John Shepperd
*Attorney, Agent, or Firm*—David Kiewit

[57] ABSTRACT

Complex, time varying codes (e.g., pseudo-random sequences) are used in an access regulating system that includes a number of synchronized elements. The system includes a central computer, or other suitable means to issue one or more time-dependent linking codes that are stored in a memory in a linking device (e.g., a hotel door key) from whence the codes are relayed to an access regulating device (e.g., a hotel door lock) that permits a user access if a stored link code matches a current access code. In a preferred system a trusted central computer and all the access regulating apparatuses have a common epochal time and a common time interval during which a given code is valid. Each access regulating apparatus uses a unique combination of start and tap vectors, known only to the specific access regulating device and to the central computer, to generate a pseudo-random access code for each time interval.

20 Claims, 7 Drawing Sheets

ELECTRONIC KAY STORING TIME-VARYING CODE SEGMENTS GENERATED BY A CENTRAL COMPUTER AND OPERATING WITH SYNCHRONIZED OFF-LINE LOCKS

BACKGROUND OF THE INVENTION

The present invention provides an access-regulating system, apparatus and method for regulating the use of secured equipment. In several cases of particular interest, the secured equipment is a door lock, or the like, and the system is used to regulate access to a secure area, such as a room of a building or a safety deposit box in a bank.

Mechanical locks have been in common use for centuries for limiting access. The misappropriation of a key or of a lock's combination, which allows access by an unauthorized person, has been a problem of long standing with such equipment. Systems that have sought to overcome this problem have failed to provide an adequate solution at an acceptable cost.

As a specific example, hotel owners have long sought a locking system for hotel rooms that would: allow a guest access to a rented room for a limited period; allow a plurality of guests access to a common hotel facility during its hours of operation (e.g., a spa); allow hotel service personnel access to rooms in a controlled and trackable way; and deny room access to a holder of a stolen, copied, or out-of-date key. Ideally, such a system could be installed without requiring extensive re-wiring of the building, and would have no operating costs associated with re-keying locks (e.g., when a guest leaves without turning in his key).

Various electronic security systems are known in which a code stored on a key, card, or other small portable device is recognized by an electronic circuit that controls a door lock. Early systems of this sort used dedicated wiring between a central controller and each lock in order to change the code that a lock would recognize whenever the room was rented out to a new guest. These early systems provided most of the desired features, but at a prohibitive cost (due to the cost of running dedicated signal wiring from a central location to each door lock) and with an intolerable risk of catastrophic failure (i.e., a power failure, or the like, could leave all the doors in the hotel inoperable).

As an improvement on early systems, Downs et al., in U.S. Pat. No. 4,870,400, teach a hotel locking system in which each lock (which may be battery-powered and independent of any dedicated wiring system) recognizes one of several codes sequentially generated by a selected algorithm. A key is generated for a given lock by a master controller that has a record of the previous valid code for that lock (this key may be valid for a limited time if a separate calendar date code is also entered on the key). When the new key is inserted in the lock, electronic circuits in the lock recognize this "next user" code, unlock the door, and reset the lock so that it no longer operates for the "previous user code." If a key is not used (e.g., is issued and then lost before the guest returns to his room), a new key, which is also recognizable by the lock, is issued with a "next-next-user" code. Downs et al. do not provide their lock with a means of writing data on the key and therefore have no way to monitor the use of the key (e.g., by a maid).

Other desired features of a hotel locking system are taught by Genest et al. in U.S. Pat. No. 4,646,080. Genest et al. teach a lock that recognizes a hierarchy of keys, some of which act only to open the lock, and others of which can be used to recode the lock.

Barrett et al., in U.S. Pat. No. 4,988,987, describe a real estate lockbox system that provides each "key" with a fixed code valid for a limited range of calendar dates. As is common in electronic systems, the "key" that Barrett et al. use is a battery powered, computer-controlled device that communicates with the lock circuitry via radio frequency transmission. In Barrett el al's. system both the "key" and the "lock" portions of the system contain computer memory circuits in which data may be written for later retrieval—thus, one can read usage history of a key from the key memory, and usage history of a lock from the lock's memory.

Hyatt and Hall, in U.S. Pat. No. 5,140,317, teach an electronically keyed system that has a microprocessor in both the lock and the key. The key, which carries the power supply to operate the lock, has a code stored in memory. This code is supplied by a master controller and is usable for a single access, whereupon the lock resets to a different code in accordance with an algorithm known to the master controller.

Miron and Neff, in U.S. Pat. No. 5,198,643, teach an electronic locking system that has a lock containing a battery-powered real-time clock and a microprocessor with an access code stored in memory. Their key contains electrically alterable read-only memory (EAROM), but no battery, and provides a means-of carrying an access code from the master controller to a designated lock. Their system uses synchronized real time clocks in each lock and in the master controller. The overall access code in their system is a combination of fixed code elements (e.g., a key access level code or a hotel name code), and re-settable timing data (time of issuance, time of latest authorized access). This system is vulnerable to attack by a thief who obtains a key, reads the data written thereon and generates a new key having the same fixed code elements and appropriate timing data code elements so that the duplicate key coacts with the lock to open a targeted door.

Many modern communication systems rely on pseudo-random, or other, complex sequential codes that change during the course of a message. These coding schemes are designed so that it is very difficult to fathom the code sequence from an intercepted message. In many such systems the sender and receiver of the message have synchronized clocks and both use the same computer algorithm to generate, in a parallel, time-locked fashion, the encoding and decoding keys that are applied to a given message fragment. Coding systems of this sort are well known in the communication art and have been described, inter alia, by W. Wesley Peterson in "Error Correcting Codes" (MIT Press, 1961) and in a chapter entitled "Modulation by Pseudo-Random Sequences" in "Digital Communication with Space Applications" (Solomon W. Golomb, ed., Prentice-Hall, 1964).

SUMMARY OF THE INVENTION it is an object of the invention to provide a system for controlling the operation of protected equipment, wherein a single master unit provides a linking element (often referred to hereinafter as a "key") with a code enabling the linking element to coact with and control an access-regulating element (often referred to hereinafter as a "lock") at a remote location for a predetermined authorization time period.

It is an object of the invention to provide an electronic door locking system in which the code required to open a door's lock changes with time. It is also an object of the invention to provide such a system in which a single master control unit can, at any time, generate and provide the necessary codes to a linking unit or key that will open a predetermined door for a predetermined interval. It is expected that such an electronic locking system would be principally used in a situation having a plurality of doors and a plurality of locks (e.g., a hotel), but it should be noted that a system of this sort could also be applied to a system having a single door (e.g., an employee entrance to a factory that could be used by all currently employed personnel).

It is a further object of the invention to provide a multi-door locking system comprising an access-control device or door lock that, in turn, includes a time keeping means and a code-calculating or code-storing means to define a valid access code at a given time; a master unit; and a security control unit that can be used, inter alia, for transferring time synchronization information from the master unit to any one of the locks.

It is yet a further object of the invention to provide a locking system for a hotel, or the like, in which an authorized user is issued a key-like device that carries a code in computer memory and that will operate with a battery-powered door lock mechanism to unlock the door during a predetermined interval. It is also an object of the invention to provide such a system that offers an audit trail on the use of each key or key-like device by having a lock write a time-of-access-request datum in a memory portion of the key or of the lock when the key is used.

It is an additional object of the invention to provide a locking system in which an authorized user is issued a key-like device that carries a code in computer memory and that will operate a battery-powered lock mechanism a predetermined number of times within a predetermined authorization interval.

It is also an object of the invention to provide a locking system for a hotel, or the like, in which a lock will generate an alarm whenever someone attempts to gain access to a room with a key that is not then valid for use in that lock.

It is an additional object of the invention to provide a locking system having a plurality of time-variable access levels so that a first key user may obtain access during periods when a second, otherwise authorized, key user is denied access.

DETAILED DESCRIPTION

Figure 1:
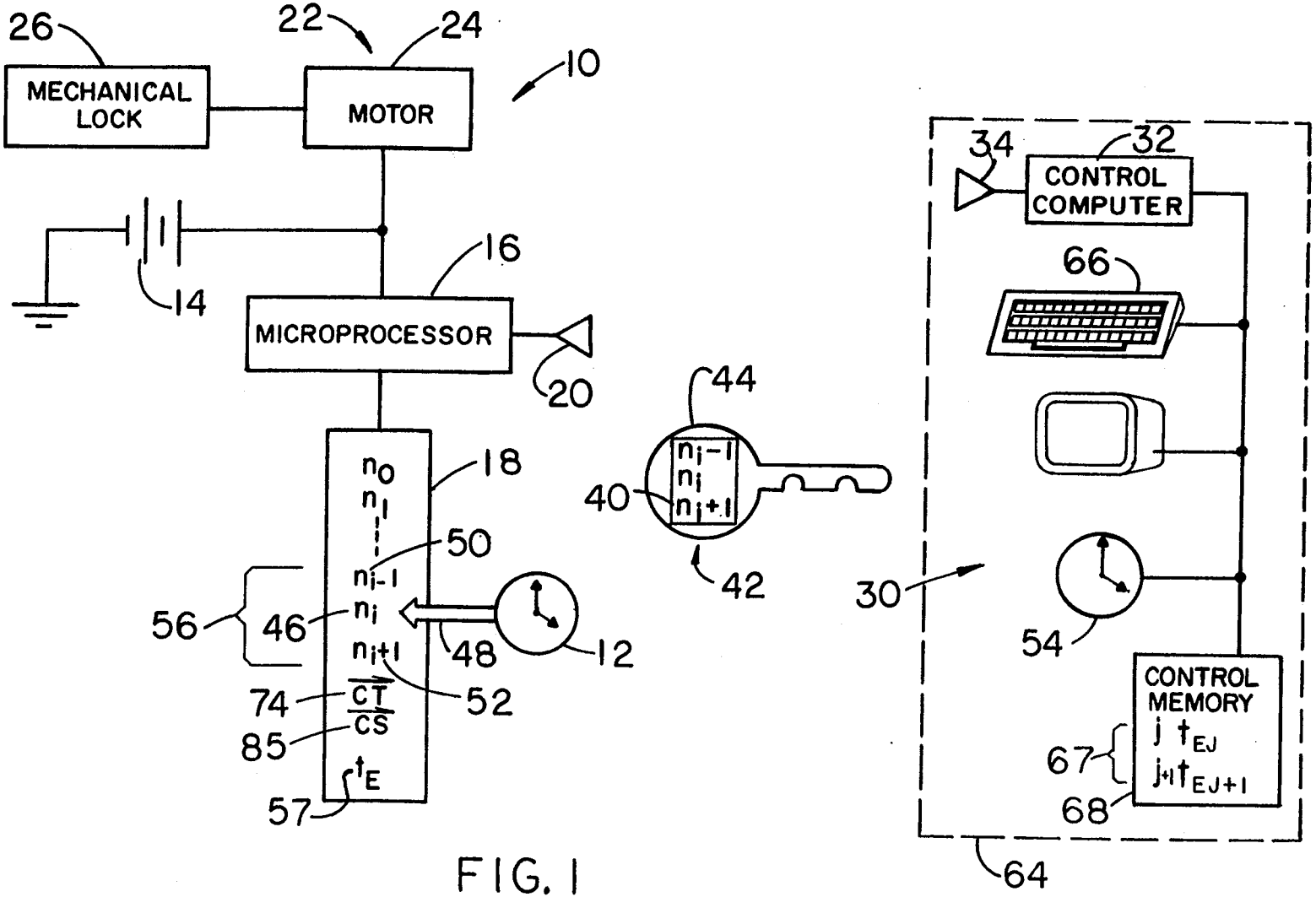
FIG. 1 of the drawing shows a block diagram of a system of the invention.

Turning initially to FIG. 1 of the drawing, one finds a schematic overview of a preferred embodiment of the security system of the invention. A plurality of access regulating equipments 10, which, for example, may be installed the doors of hotel rooms, each contains a timing device 12 (hereinafter called an "access clock"), which is preferably a digital clock with a serial digital output; a battery 14, a microprocessor 16 (hereinafter called the "access computer") having memory 18 (hereinafter called the "access memory"), a communication apparatus 20 (which is preferably bi-directional), and an electro-mechanical actuator 22, that in the specific case of use in a hotel, may be an electric motor 24 that operates a mechanical lock 26. A master control apparatus 30, which is preferably a small computer 32 (hereinafter "control computer"), can determine a current code or range of codes that are valid for one of the access regulating equipments 10 and write that code (hereinafter called a "link code"), via writing means such as a communication port 34, into a link memory 40 that is part of a linking device 42. In the specific example of a hotel security system, the linking device serves the function of a "smart" room key 44.

The access-regulating device 10, at any given time, has a code 46 (indicated by pointer 48 in FIG. 1) that is a currently valid access code. When the smart key 44 is inserted into the communication port 20, its link code is read and compared, by access computer 16, with the current access code 46.

Alternately, the access regulating computer 16 may verify the current access code 46, the access code 50 corresponding to the immediately preceding interval, and the access code 52 corresponding to the immediately subsequent interval before actuating the door lock.

For any given security system of the invention, all the clocks 12, 54 employ a standard preset interval, or a limited plurality of such intervals, during which an access code 46 is valid. For the example of a hotel security system, a one hour interval may be used, and a guest's key contains codes valid for, say, twenty hours (As a further example, during this twenty hour period the same guest key may be used to gain access to the hotel's spa for only some of the one hour intervals—i.e., the spa may be closed during the late night and early morning hours). At the end of each such interval, each access regulating portion of the system gets a new currently valid code. In the illustration of FIG. 1, this is illustrated schematically as being carried out by shifting a pointer 48 from an initial selected code 46 to the next sequential code 52 of a block of codes 56 stored in a memory 18. As will be discussed subsequently herein, in a preferred embodiment an access regulating equipment 10 uses an algorithm, carried out by the access computer 16 at the beginning of each new interval, to generate the next valid code in a sequence, rather than storing all valid codes in memory 18. As subsequently used herein, "getting a code" will embrace both the process of looking that code up in a computer memory or written list, and the process of calculating that code by means of an algorithmic procedure.

In addition to a current time value, supplied by the access clock 12, each access-regulating equipment 10 in a system of the invention includes an epochal time value, $t_E$ 57, an initial state vector 85 and an initial tap vector 74 stored in the memory 18 of the microprocessor 16. In the preferred system, the epochal time is the same for all the locks 10, while each lock has unique values of the initial state 85 and tap 74 vectors, the use of which will be subsequently discussed. The valid access code 46 is selected to be a function of the time difference between the current time and this epoch. Thus, a single array of code values 56 (or, alternately a common code generating means) can be used for all access apparatuses 10 in a given system. An epochal timing arrangement, which may be realized with many different specific approaches, requires that each access limiting equipment have a time keeping mechanism synchronized with time keeping mechanisms used by the central portion of the system. Codes based on an elapsed time since an epoch will be referred to hereinafter as epochal time codes.

Figure 2:
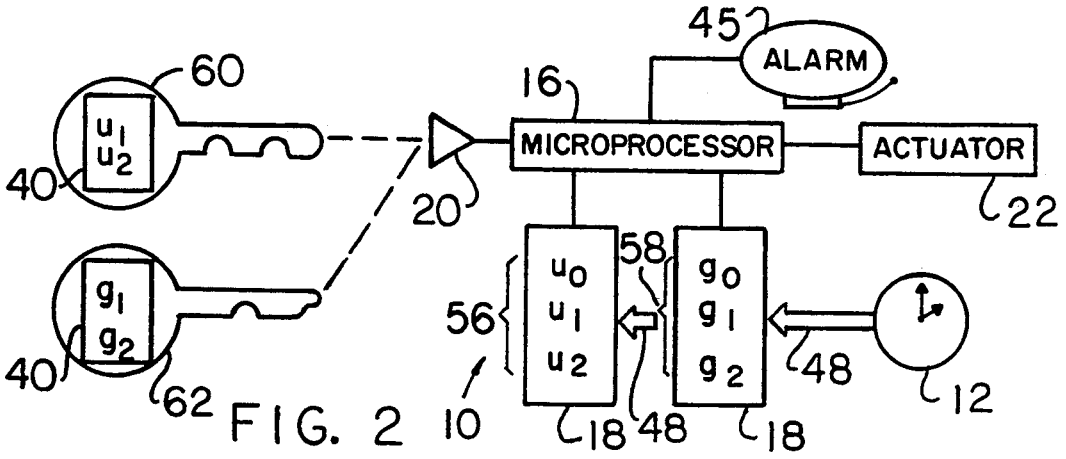
FIG. 2 of the drawing shows a block diagram of a multi-level access apparatus.

Turning now to FIG. 2 of the drawing, one finds an access regulating device 10 that incorporates two code sets 56, 58—i.e. a multi-epochal code apparatus. An arrangement of this sort can be used in a hotel, for example, to provide a high average level of security in a system that has some keys that are widely distributed (e.g., a guest's room key 60) but used for relatively few locks (e.g., a guest room and a spa) and other keys (e.g., a security guard's key 62) that are physically secured and issued only to trusted personnel. The guest key 60, in this example, may incorporate an EEPROM memory 40 that has capacity to store up to two hundred link codes (i.e., enough to span a week if the code validity interval is one hour). For a hotel property with two hundred rooms the corresponding guard's key 62 would have to have a memory with a capacity of nearly five thousand codes if it were to be replaced every day. To avoid the cost and perceptible read delays associated with a large memory, it is preferable to provide a guard key 62 with second link code set that works with a second, longer, time interval. Thus, for example, if the pointer 48 is stepped through the code set 58 at a rate of one step per week, the guard's key 62 (which becomes obsolete once a week) can have a memory that is the same physical size as that used in the guest's key 60. It will be understood that although this example was presented with specific reference to apparatus that used two separately stored code arrays 56, 58, the same results can be obtained by stepping two pointers through a single code table at different rates, or by using a single algorithm to calculate a valid current code from different intervals for each subset of the epochal coding system.

In the hotel security system discussed above, the linking device 42 may be a key-shaped item inserted into a lock where it is read by physical contacts in the communication apparatus 20. It should be noted that a variety of other memory-bearing devices may serve as the linking device 42, and many of these could be configured to use a variety of non-contact, wireless communication means for communicating with the link-code issuing device or with the access regulating apparatus. In an alternate hotel room-key system, for example, the linking device could be a wallet-size card that could be brought near the door and read out via inductive coupling. In other systems, such as a control system for a vehicle gate that will be subsequently described herein, the linking device may be a vehicle-mounted apparatus that communicates with the access-regulating apparatus via a simplex infra-red beacon. Moreover, although the linking device 42 has been heretofore described in terms of its function of carrying a code to an access-regulating device, it will be clear to those skilled in the computer arts that a smart hotel key 44 that included EEPROM link memory 40 could as well carry data (e.g., time of access and number of accesses to a spa) back to the master controller 32 for use in generating a variety of management reports.

Turning again to FIG. 1, one finds a master controller 32 that is expected to be located in a physically secured location 64, and/or that uses a variety of known identification methods (e.g., a password entered at a keyboard 66, automatic signature recognition equipment, etc.) to ascertain that someone who tries to use the controller 32 is properly authorized to do so. If the master controller 30 is a computer 32, as is expected to be the case in most applications, a variety of well-known hierarchical access control methods can be used with it—e.g., at a relatively low level of password authorization a desk clerk can load current access codes into a key 44 to be given to a guest at the time of registration; at a higher level of authorization, a hotel manager could generate reports on number and time of key issuances, use of common facilities, etc. Other security features, such as having an alarm 45 controlled by the access equipment 10 sound when an unauthorized key 44 was presented, could also be supplied by the system of the invention.

To perform its essential function of loading current access codes into a linking device 42, the master controller 32 may store values of the epoch, the operating interval, and the specific algorithm used by each access-regulating apparatus 10. In the simplest embodiment, the 'controller' 30 need be no more than: a) a printed register listing the access code for each lock 10 for each period; and b) a manually operated means of entering the valid codes for a desired range of time for a target access-control device into a linking device. In the preferred embodiment, however, the master controller 30 is a control computer 32 that has a table 67 of specific algorithms and of the lock associated with each algorithm stored in control memory 68. In this case, when the desk clerk enters a room number and a projected time of stay via the keyboard 66, control computer 32 fetches the system epoch and the algorithm employed by the appropriate lock from memory, and uses the epoch and the time read from the control clock 54 in the selected algorithm to generate appropriate access codes to be written into EEPROM 40 on a key 44 via the communication port 34.

The code-based security system described above relies on all the clocks in a given system being synchronized. Thus, the time keeping mechanism used in the access regulating apparatus 10 should be accurate enough to ensure that no clock drifts out of synchronization with the master controller's clock 54 by more than one interval during a reasonable service period of the system. For the hotel example cited frequently above, known battery powered clocks (e.g., a Dallas Semiconductor DS1202, which uses a single external 32 kHz digital watch crystal and which can be directly interfaced to a microprocessor using only four connections) that have a drift of about one second per day, can be used as the access clock 12. This indicates that a locking system of the invention that used this design approach could run for about five years before maintenance service was required to re-synchronize all the locks 10 to the master controller 32. Since the batteries in the locks would have to be replaced after about five years as well, the achievable drift appears to be well within operating limits.

In the interest of preventing someone from defeating a code-based security system, the encoding system should be difficult to decrypt, even if the assailant has access to a number of codes—e.g., if someone were to collect and read out a number of used guest keys at a hotel. Better security is offered by systems that provide long codes (e.g., that resist simple trial-and-error attempts to defeat the system) and/or codes that have no clearly apparent sequential relation (e.g., sequential codes should be nearly randomly related to each other).

Figure 3:
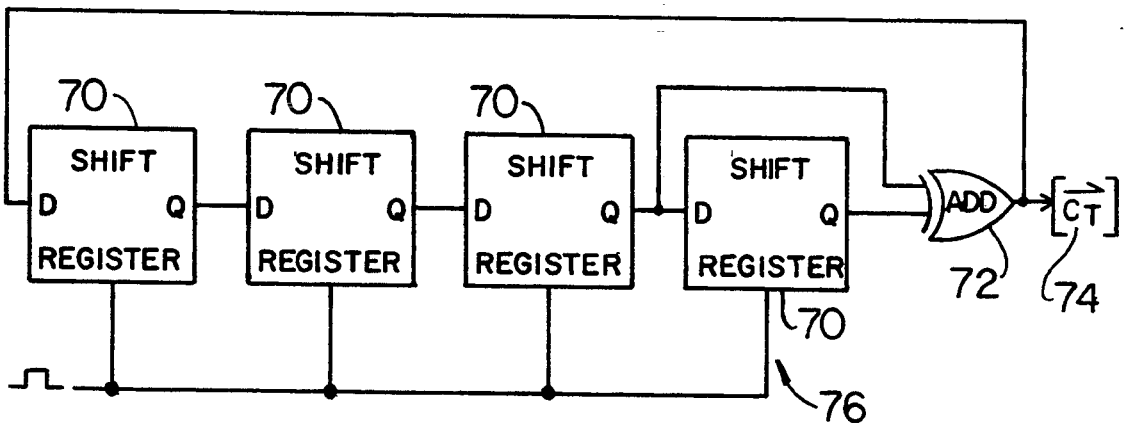
FIG. 3 of the drawing is a schematic block diagram of a pseudo-random number generating circuit.

The preferred embodiment of the invention uses pseudo-random number generators whose structures and initial states are derived from physical thermal processes. Such random noise generators are well known in the communication arts, and can be realized in a physical circuit (e.g., the array of shift registers with feedback shown in FIG. 3), in an algorithmic simulation of such a circuit, or with various combinations of hardware and software. In some systems, as will be discussed subsequently, it is most efficient to use a plurality of shift registers in the master controller 32 to generate codes; and to use an algorithm simulating the operation of that hardware in the access regulating equipment 10 to generate access codes. An elementary pseudo-random number generator (PRG) is shown in FIG. 3 of the drawing as made up of several shift registers 70 with a feedback connection from a modulo two half adder 72. This type of linear sequence generator is well known in the art of secure communication and generally provides a tap vector 74 with a maximum length of one less than two raised to the Nth power if each shift register 70 has N stages.

Figure 4:
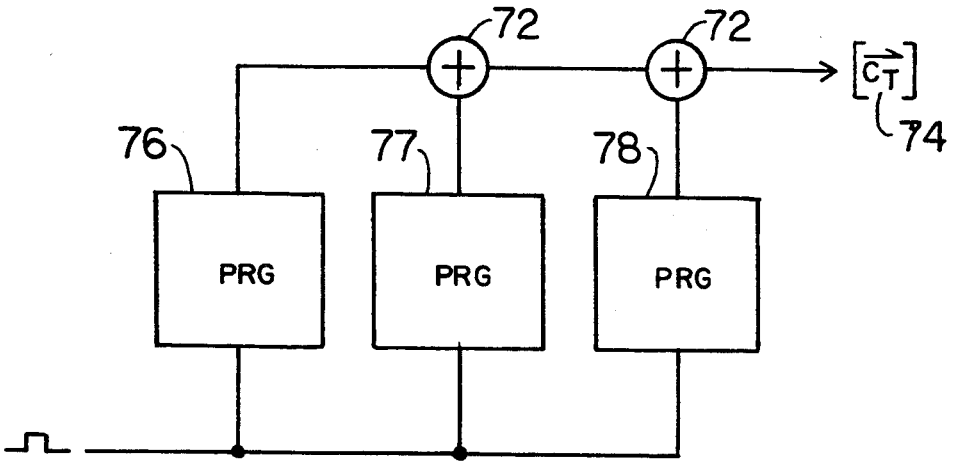
FIG. 4 of the drawing is a schematic block diagram of a more complex pseudo-random number generating circuit.

Cryptologists have long known that it is easy to compute the structure of a PRG from a partial sequence of its output values. As an inhibition on code breaking, more complex structures are used. One such structure, which is part of the preferred embodiment of this invention, is shown in FIG. 4 of the drawing where a plurality of PRGs 76–78 of relatively prime lengths have their outputs added together by modulo two half adders 72 to generate a relatively unbreakable code. In one embodiment of the invention an effective code length that is substantially longer than the actual code length is obtained by using the time-dependence of the system. In this case the access regulating mechanism, after successfully matching its current access code with a code from the linking device's memory, then matches the code that immediately preceded (and/or followed) the current access code with the corresponding preceding (and/or following) code in the linking device's memory.

Figure 5:
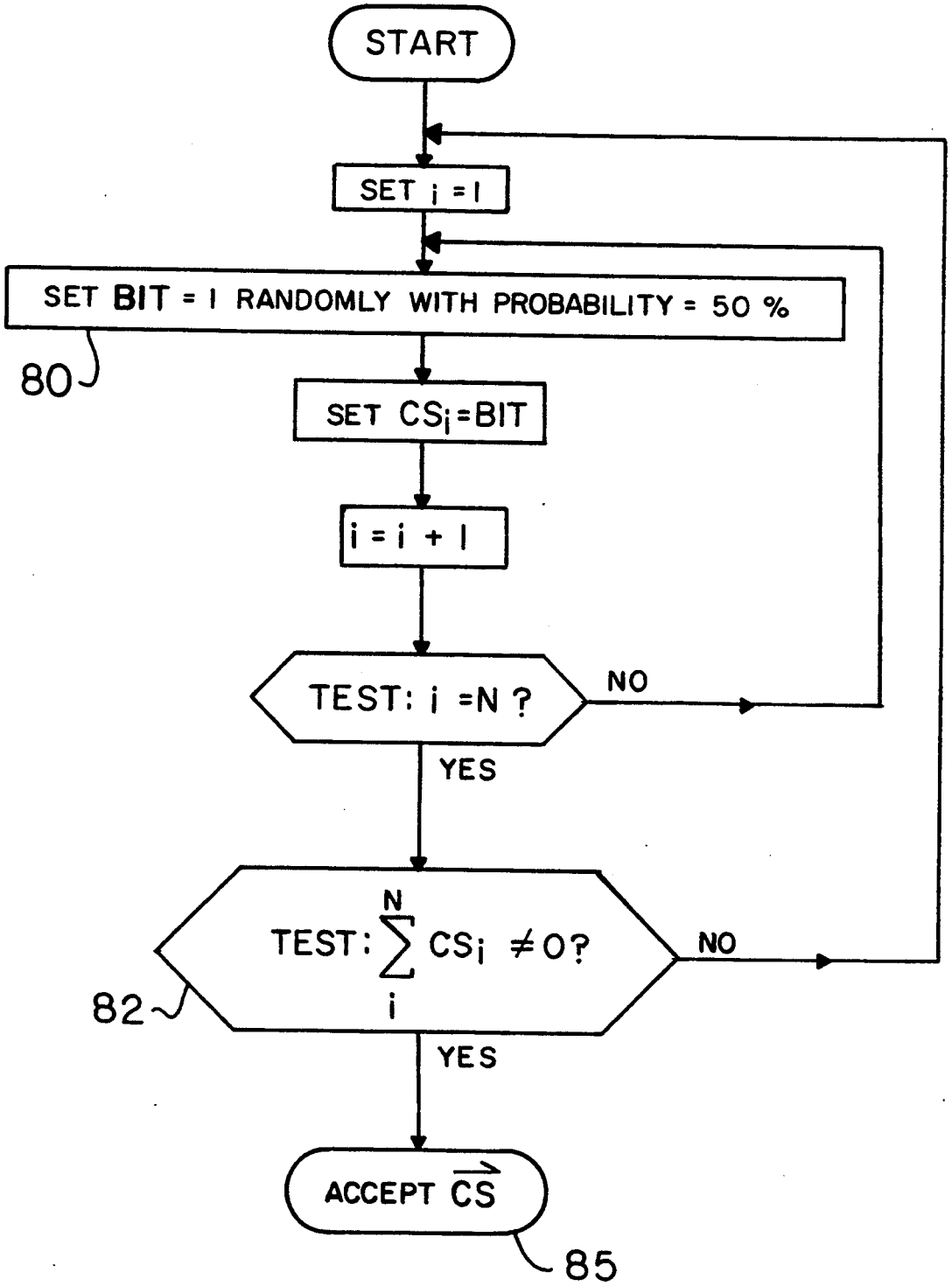
FIG. 5 of the drawing is a logical flow chart showing a sequence of steps resulting in the definition of an initial state vector.
Figure 6:
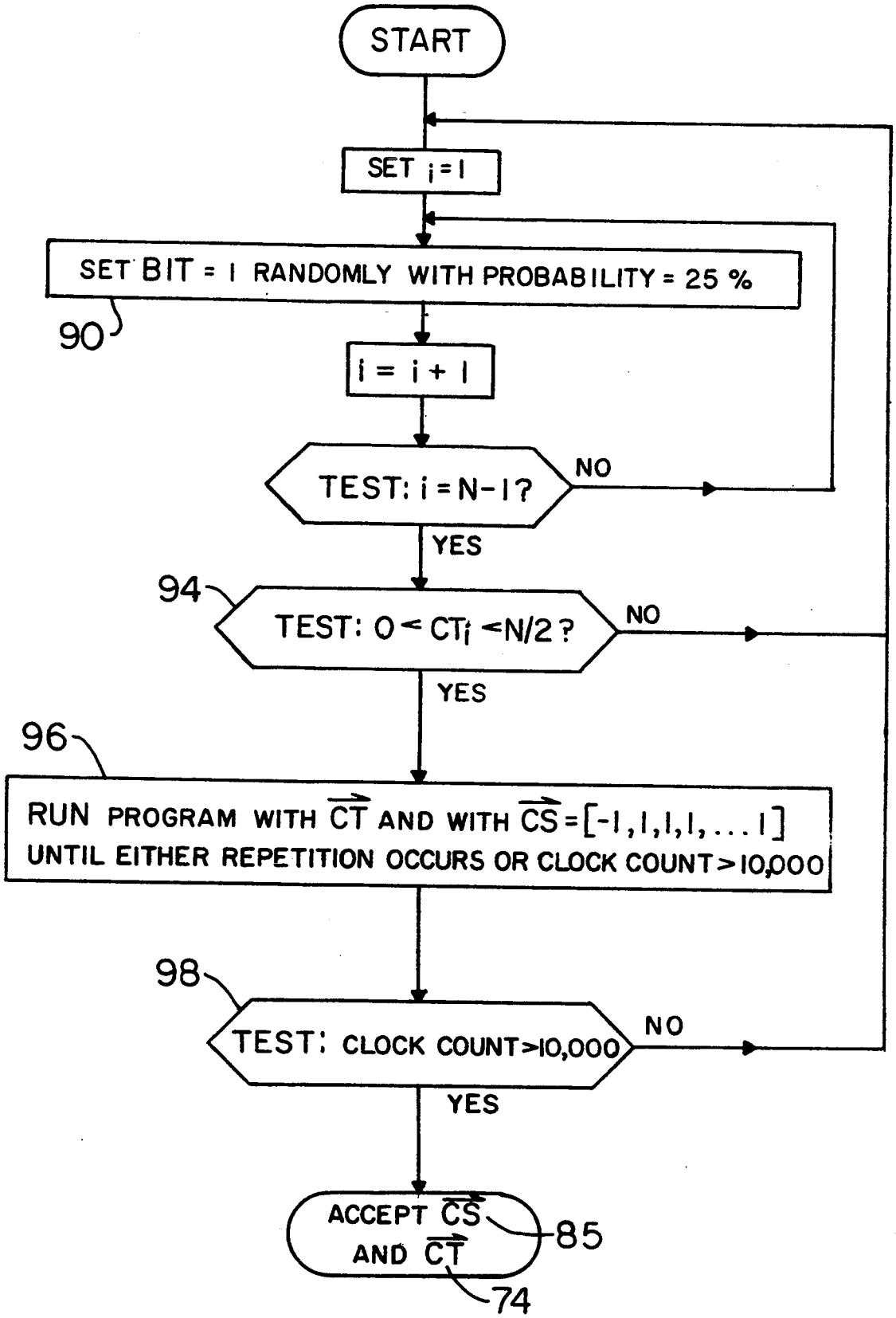
FIG. 6 of the drawing is a logical flow chart showing a sequence of steps using an initial state vector and a tap vector to generate an acceptably complex pseudo-random number sequence.

The logical steps in the generation of the initial state for an access-regulating apparatus of the system may now be understood with reference to FIG. 5 and 6 of the drawing. Initially (step 80) a trial start vector is generated according to a process that provides a 50% probability that there is a zero in any given bit position. This trial vector is tested, in step 82, to ensure that it has at least one non-zero bit and is accepted for any non-zero value that occurs. The start vector accepted in step 82 of FIG. 5 is then used in a random tap vector configured pseudo-random generation sequence shown in FIG. 6 of the drawing. The tap vector is initially defined (in step 90) with a probability of 25% of having a binary one in any given bit position, and is then subjected to a minimum sequence length test (in step 92) to assure that it is large enough to generate a PRG output; and to a polynomial weight test (in step 94) to assure that less than one half the register size is used. The polynomial weight test is done in the interest of computational efficiency. The trial tap vector and the trial start vector are then tested in steps 96, 98 to ascertain that the PRG sequence that they generate is nonrepetitive for at least predetermined minimum number (which is set equal to ten thousand in the figure) codes.

Figure 7:
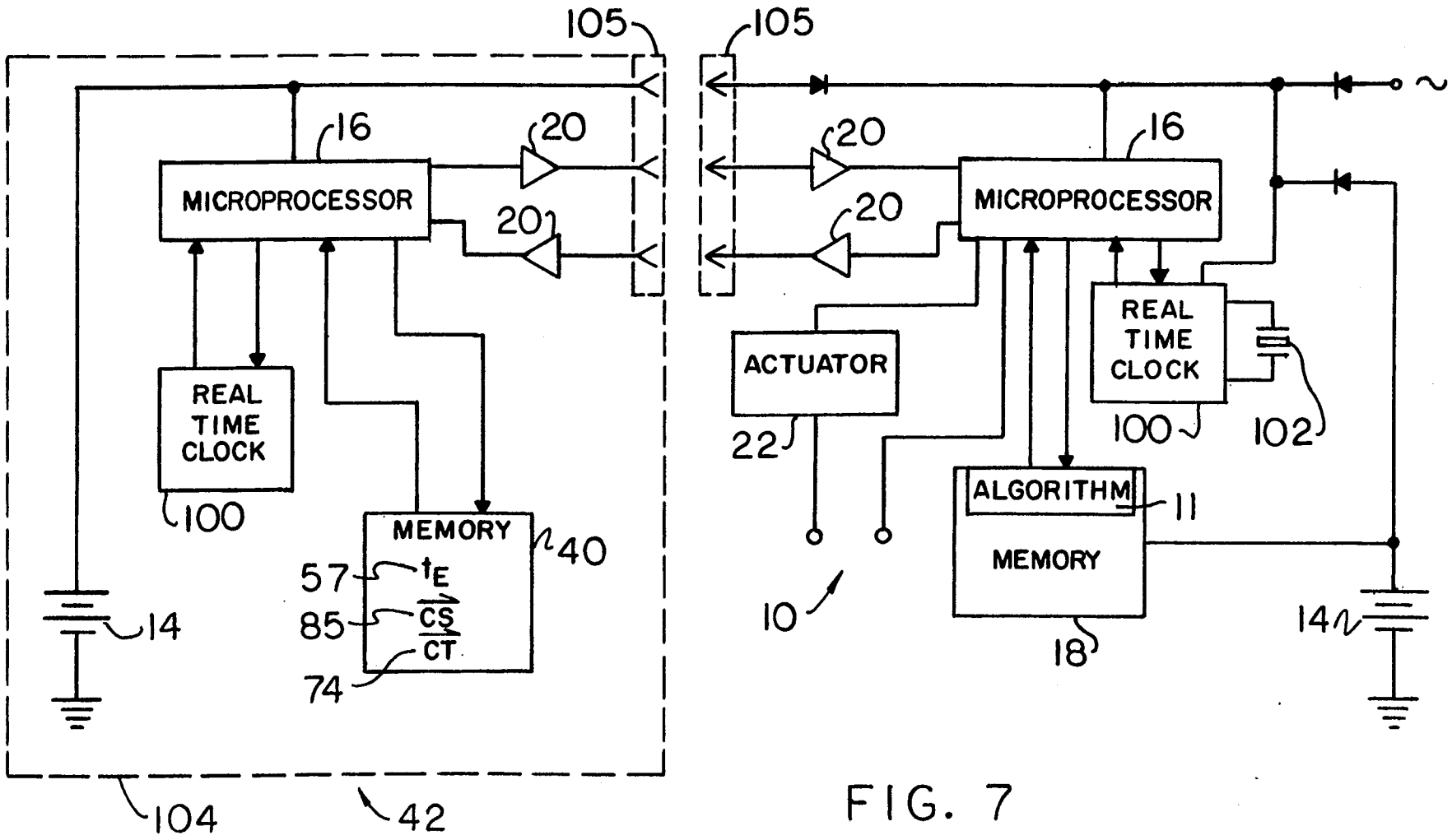
FIG. 7 of the drawing is a schematic block diagram of a door access control equipment of the invention.
Figure 8:
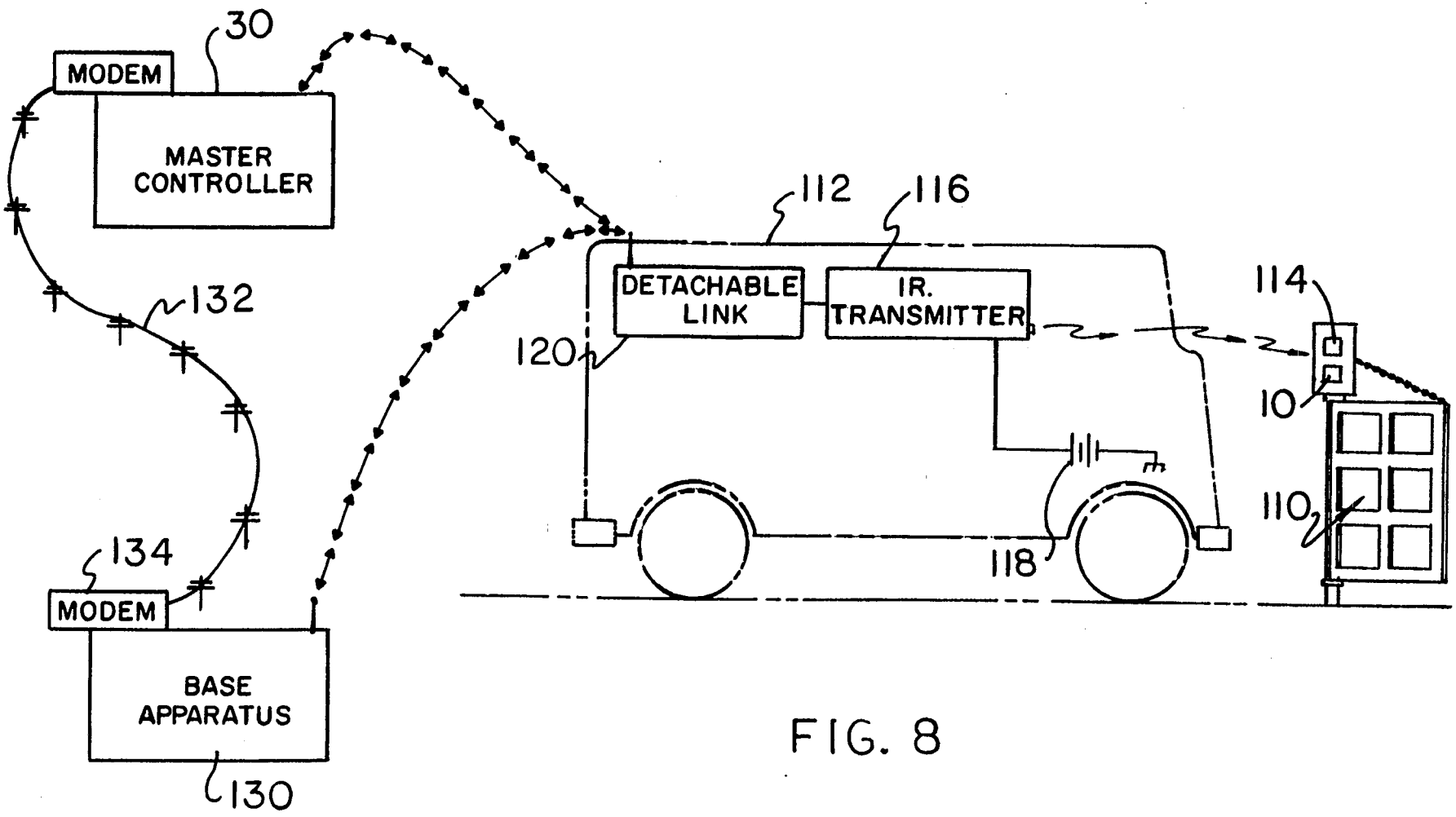
FIG. 8 of the drawing is a schematic diagram of a vehicle gate control apparatus of the invention.

Turning now to FIG. 7 of the drawing, one finds an example of a preferred embodiment of the access-regulating equipment 10 for a system of the invention, as applied to a hotel room key system. The access computer 16 is preferably an Intel 80C51 microprocessor. It is powered by a battery 14, which is also used to operate a motor 24, or other electro-mechanical actuator that is suitable for unlocking the door. The access clock 12 can consist of a real time digital clock 100 (e.g., a Dallas Semiconductor DS1202), and external 32 kHz digital watch crystal 102 that provides the necessary time keeping functions. A non-volatile access memory 18, may be an XL24C16 EEPROM made by Excel Microelectronics of San Jose, Calif., and is used to store the initial state vectors 85, tap vectors 74 and interval step size data needed to implement the code generation sequences in the lock's microprocessor 16. It will be noted that the provision of non-volatile memory for this function can be used to make the lock fail in a safe and controlled way when the battery is depleted—e.g., a hotel staff member, equipped with a linking apparatus 42, comprising a linking controller 104 that includes a microprocessor 16, a battery 14 and a memory 40 that carries the epoch data–can power the microprocessor 16 via connections 105 associated with communication ports 20. The access microprocessor 16, can be programmed so that if it "wakes up" under external battery power at a time when its local battery 14 is dead, it will set the current access code to the epochal value so that the door may be opened.

Figure 9:
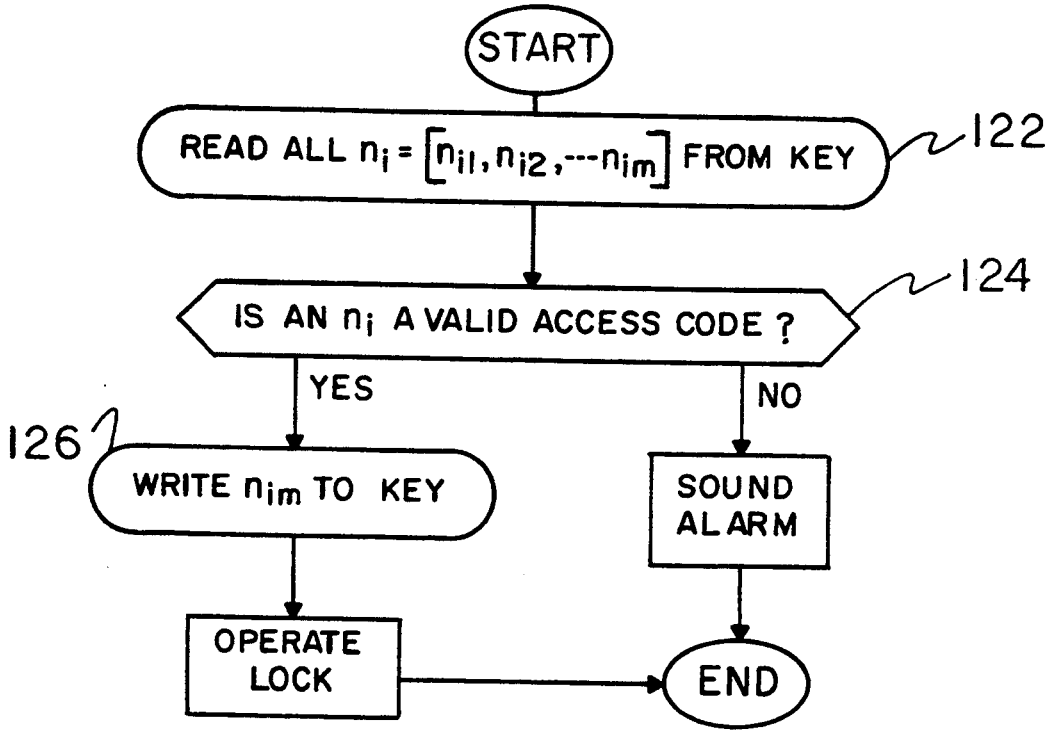
FIG. 9 of the drawing is a flow chart showing steps in an audit trail process that are executed by an access control computer.
Figure 10:
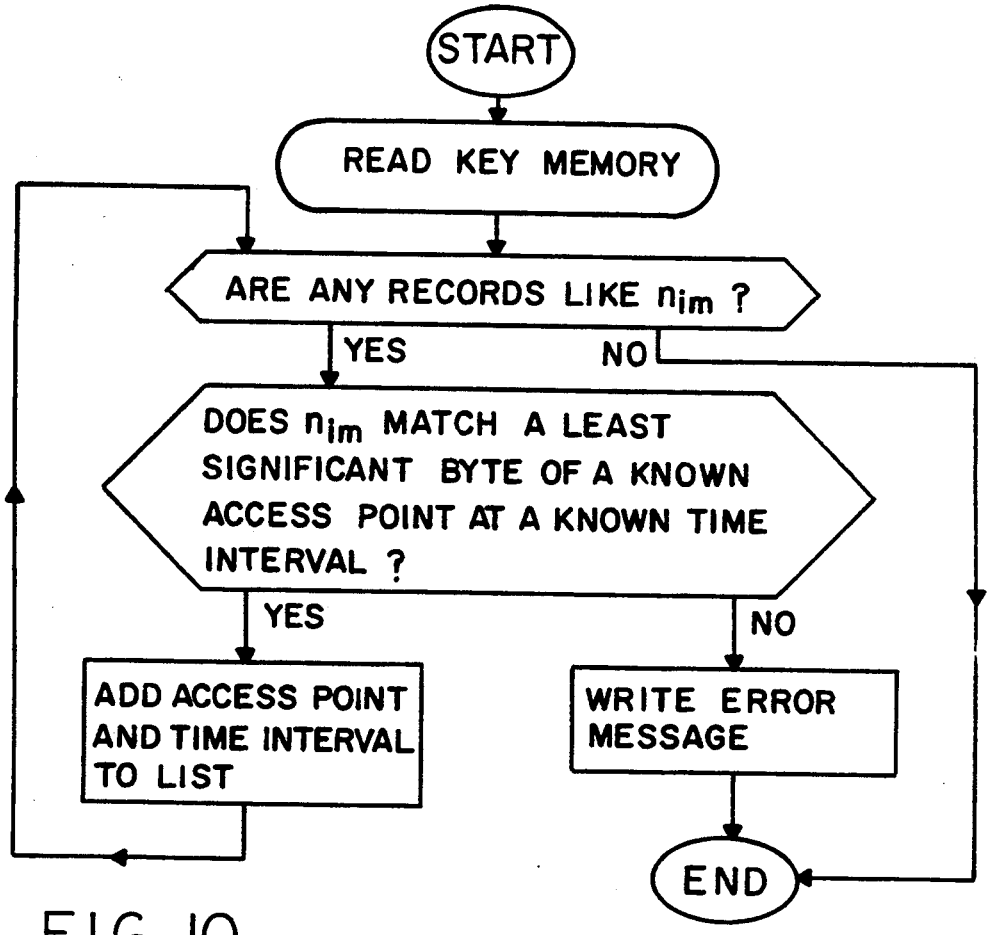
FIG. 10 of the drawing is a flow chart showing steps in an audit trail process that are executed by the central control computer.

The guest key linking device 44 used in the hotel example preferably contains little more than a non-volatile electrically alterable memory 40 (e.g., an XL24C16 EEPROM), and the electrical contacts necessary for it to connect to the communication ports 34 of the access equipment 10 and the master controller 32, respectively. In a preferred embodiment of the system, the lock 10 reads all the codes from the memory 40 in the linking device 42 as shown in step 122 of FIG. 9 and tries to match them with the currently valid access code, as shown in step 124. If a match is found, access is granted (e.g., the electric motor 24 unlatches the door) and the electronic lock 10 writes a datum (e.g., the least significant byte of the code used to gain access, as shown in step 126) indicative of the time of access into an unused portion of the memory 40 on the linking device 42. When the key 44 is later returned to the master controller 32 (e.g., at check out) the master controller 32 can construct a list of all the times that the specific key 44 was used to gain any allowed access, as shown in FIG. 10 of the drawing. Such a feature is of interest, for example, in constructing an audit trail of all the rooms that a maid entered at various time during a work shift. The ability of the master controller 32 to construct such an audit report depends on the code sequence being long enough that no two access-regulating equipments have the same access code during an interval when the key is valid, and on the master controller's having data available so that it can uniquely associate a room number and a clock interval with the code in the key memory used for access.

Another application that may be considered for the invention is that of automatically regulating access to a safety deposit box. In this application the master controller would ideally include automatic identification means (e.g., a signature verification equipment, or a keyboard and magnetic stripe reader to allow a personal identification number to be used in conjunction with an identification card) so that a customer who wanted access to his or her safety deposit box would identify himself or herself to the equipment and be issued a key-like linking device that would open the designated box. The "key," in this application, would preferably include the battery used to operate the lock, so that only a small battery would be needed in each safety deposit box door to keep the time-keeping function operating. The interval used here would be shorter than for the hotel case, as the user would be granted access for a total period of an hour or so instead of for a day or more.

Another series of uses for the invention can be found in systems in which a vehicle's degree of access to a roadway or its ability to enter or leave a delimited area is controlled. As an example, consider a system of the invention that could be used to open and close a vehicle gate 110 for an authorized vehicle 112. In this case the access-regulating device 10 would be located at the gate 110 and could incorporate an infra-red receiver 114 suitable for receiving pulsed infra-red signals of the sort commonly used to control in-home entertainment equipment. The epoch 57 and initial state vector 85 for all gates limiting access to a given reservation or property could be set to be the same so that the linking device could send out the same code to access any one of a plurality of such gates. The linking apparatus 42 would incorporate an infra-red transmitter 116 powered by the main power supply 118 of the vehicle 112 in which it was installed, and could include a detachable portion 120 that could be removed from the vehicle for communication with the central controller. Alternately, the linking apparatus 42 could include a permanently installed base apparatus (130) that received codes (e.g., over a communication network 132 via an internal telephone modem 134) from the master controller 30 and passed these codes on to the infra-red beacon control portion of the linking apparatus 42 installed in the vehicle 112. The master controller, for example. could download access codes valid for a week into memory in the linking apparatus.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed and desired to be secured by Letters Patent is:

1. In an electronic security system comprising an access-regulating apparatus, a linking apparatus and a centrals means of issuing a link code, said access-regulating apparatus comprising an access clock having an output, an access computer having an access memory, and an actuator, said linking apparatus comprising a link memory, said linking apparatus receiving said link code from said code issuing means and communicating said link code to said access regulating apparatus, whereby said actuator acts under control of said access computer if said link code matches an access code stored in said access memory, an improvement wherein said access computer uses an access code generating algorithm having as inputs said output of said access clock, an epochal time datum and an initial state datum to generate said access code.

2. A system of claim 1 wherein said central means of issuing a link code comprises a control computer having a control memory and a control clock, said control clock having an output, said control computer storing said epochal time and said initial state data in said control memory, said control computer comprising means to use said epochal time datum, said initial state datum and said output of said control clock to generate a link code matching said access code.

3. A system of claim 2 wherein said means to generate said link code comprises a link code generating algorithm.

4. A system of claim 2 wherein said means to generate said link code comprises a plurality of shift registers and a feedback means.

5. A system of claim 1 wherein said access-regulating apparatus comprises means to write into said link memory a datum representing a time at which said linking apparatus communicated said link code to said access-regulating apparatus, and wherein said central means of issuing a linking code comprises means to read said datum from said link memory.

6. A system of claim 5 wherein said time-representing datum comprises a portion of said access code.

7. A system of claim 6 wherein said portion of said access code comprises the least significant byte thereof.

8. A system of claim 1 wherein said access code generating algorithm generates an access code at the beginning of each of a sequence of intervals of predetermined duration, and wherein said central means issues a plurality of said link codes, each said link code of said plurality of link codes matching a said access code for a said interval of said sequence of said intervals and wherein said central means writes said plurality of link codes into said link memory.

9. A system of claim 8 wherein said access computer operates said actuator if a first of said plurality of link codes matches that said access code corresponding to a first predetermined interval and a second of said plurality of link codes matches that said access code corresponding to the immediately preceding interval and a third of said plurality of link codes matches that said access code corresponding to the immediately following interval.

10. A system of claim 8 wherein said access code generating algorithm generates a first plurality of access codes, each said access code of said first plurality of access codes generated at the beginning of each of a first sequence of intervals having a first predetermined duration, and wherein said access code generating algorithm further generates a second plurality of access codes, each said access code of said second plurality of access codes generated at the beginning of each of a second sequence of intervals having a second predetermined duration, and wherein said central link code issuing means issues two values of said link code, one of said two values of said link code matching a said access code of said first plurality of access codes and the second of said two values of said link code matching a said access code of said second plurality of access codes, whereby said access control apparatus actuates said actuator if either of said two values of said link code matches either of said two said access codes.

11. A system of claim 1 further comprising a linking controller, said linking controller comprising a linking clock, a linking computer and a means of resetting said access clock.

12. A system of claim 1 wherein said linking apparatus comprises a wireless transmitter.

13. A system of claim 12 wherein said linking apparatus comprises a base apparatus comprising a modem and communicating over a network with said central code issuing means, and a portable apparatus, communicating with said base apparatus and controlling said wireless transmitter.

14. A system of claim 1 wherein said linking apparatus comprises a key, said link memory comprises an EEPROM, and said access-regulating apparatus comprises a lock controlling the opening of a door.

15. A system of claim 1 wherein said central means of issuing a code comprises a control clock and data storage means, said data storage means containing a plurality of values of said link code, each said value of said plurality of values matching a said access code at a predetermined time.

16. An electronic lock comprising an access computer, an access clock having an output, an unlocking means controlled by said access computer, a means of reading an external memory, a power supply powering said access computer, said access clock and said unlocking means, an access memory operatively coupled to said access computer, said access memory storing a epochal datum, an initial state datum and an access code generating algorithm, said access computer using said epochal datum, said initial state datum and said output of said access clock as inputs to said algorithm, said algorithm generating an access code valid for a predetermined interval, said access computer reading said external memory during said predetermined interval and operating said unlocking means if a datum in said external memory matches said access code.

17. The electronic lock of claim 16 wherein said external memory comprises an EEPROM and said unlocking apparatus comprises a motor.

18. The electronic lock of claim 16 further comprising an audible alarm, said alarm sounding if no datum in said external memory matches said access code.

19. The electronic lock of claim 16 further comprising means of writing into said external memory a datum indicative of the time at which said external memory means was read by said lock.

20. The electronic lock of claim 16 wherein said power supply in said lock supplies electric power to read said external memory.

* * * * *